United States Patent [19]

Steckmesser

[11] 4,218,788

[45] Aug. 26, 1980

[54] ADJUSTABLE MATTRESS SUPPORT FOR STRETCHER OR THE LIKE

[75] Inventor: Bradd E. Steckmesser, Manitowoc, Wis.

[73] Assignee: American Hospital Supply Corporation, Evanston, Ill.

[21] Appl. No.: 18,978

[22] Filed: Mar. 9, 1979

[51] Int. Cl.[2] ..... A61G 7/10; A47C 3/32

[52] U.S. Cl. ..... 5/74 R; 5/86; 297/377

[58] Field of Search ..... 5/60, 66–68, 5/74, 75, 86; 297/377

[56] References Cited

U.S. PATENT DOCUMENTS

| | | | |
|---|---|---|---|
| 979,260 | 12/1910 | Collier | 5/90 |
| 1,608,848 | 11/1926 | Gallowitz | 297/377 |
| 1,677,218 | 7/1928 | Shand | 5/75 |
| 2,438,059 | 3/1948 | Lackey | 5/74 |
| 3,821,821 | 7/1974 | Burst et al. | 5/68 |
| 3,972,081 | 8/1976 | Stern et al. | 5/68 |
| 4,025,972 | 5/1977 | Adams | 5/68 |

*Primary Examiner*—Casmir A. Nunberg
*Attorney, Agent, or Firm*—Larry N. Barger

[57] ABSTRACT

An adjustable foot or head portion of a hospital stretcher or bed with improved construction for easy manipulation without binding. A pair of hinged braces have a series of notches along one edge which engage protruding lugs on the stretcher for various height adjustments. A transverse spacer joins the braces adjacent the notches to insure sufficient lateral clearance for smooth movement between various height adjustments of the mattress support. Also, a separately formed U-shaped retention member connected to each brace maintains the lug in close proximity to the brace notches during adjustment.

5 Claims, 3 Drawing Figures

ADJUSTABLE MATTRESS SUPPORT FOR STRETCHER OR THE LIKE

BACKGROUND

U.S. Pat. No. 3,821,821 shows an adjustable foot area of the hospital bed which has a pair of braces 86 with notched dogleg sections. These dogleg sections each slide in a loop retainer 90. This construction has certain problems in that the braces bind in the loop retainer, particularly when the adjustable foot section of the bed is unevenly loaded. This may occur when the patient is not lying directly in the middle of the bed or stretcher when an adjustment to the foot section is made.

Another U.S. Pat. No. 3,972,081 utilizes a series of holes 332, 333 in a substructure of the stretcher or bed. Hinged brace 327 has a tab 329 that fits into these holes. Here again the problem of slight lateral cocking of the adjustable mattress support can cause the braces on each side of the stretcher to bind at their particular openings during the adjustment procedure. Also, with the construction described in this patent, it would be easy to get the tabs in holes that were not laterally corresponding to each other. This would cause a warping or cocking of the stretcher's foot section.

This warping is also apparent in wooden lawn chairs that have been available for many years. Such lawn chairs have an adjustable back support with a pair of braces similar to those shown at 68 in U.S. Pat. No. 3,821,821. The chair has a base section similar to 18 that has a series of notches along its upper edge. A transverse wooden dowel between the lawn chair braces 68 engages these various notches to adjust the back of the lawn chair to various angular positions. The big problem is that the dowel and braces twist and the dowel engages notches that are not directly opposed to each other on the two base rails. This causes cocking of the lawn chair back.

SUMMARY OF THE INVENTION

The above problems have been overcome by a unique construction of an adjustable foot or head area of a stretcher or the like. The hinged braces include notches which are longitudinally spaced along the braces and these notches engage stationary lugs on a substructure of a stretcher below the mattress support. A transverse spacer member extends between the two notched braces adjacent their notched areas to insure that the braces move in unison at their notched areas. This provides sufficient clearance between the braces and a substructure rail supporting the lugs. This causes laterally opposed notches in the braces to simultaneously engage their respective lugs without twisting or cocking of the hinged mattress support section. A separately formed member, such as a U-shaped rod, holds the lugs in close proximity to the notched braces during adjustment and smoothly slides along the lugs without substantial abrasion or binding. Alternatively, the notched braces can integrally include the member which holds the lugs.

THE DRAWINGS

DETAILED DESCRIPTION

Figure 1:
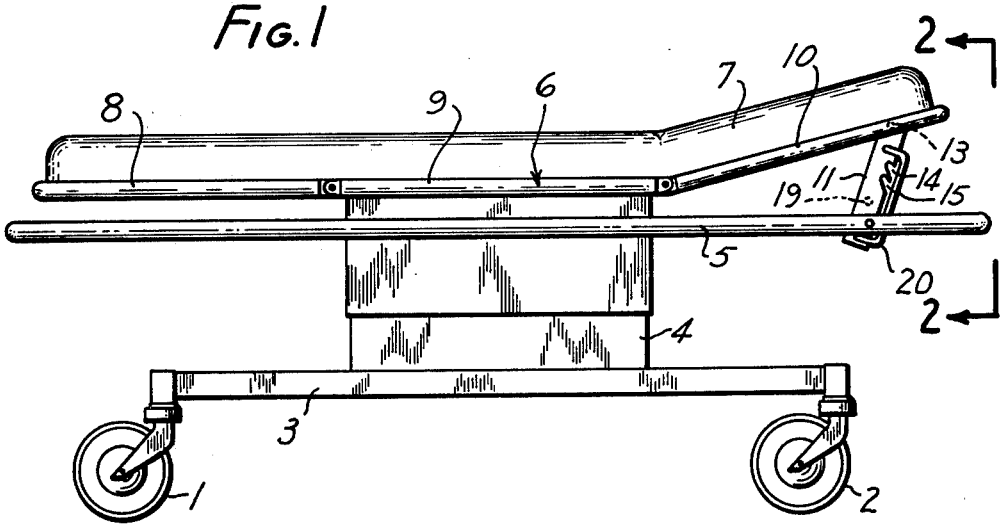
FIG. 1 is a side elevational view of a hospital stretcher.

In FIG. 1, a hospital stretcher is shown with casters 1 and 2 attached to a caster support 3. A telescopic section shown schematically as 4 raises and lowers a stretcher substructure 5 and a mattress support 6. Mattress 7 rests on mattress support 6.

In FIG. 1, the mattress support has a head section 8, a middle section 9, and a foot section 10. The three mattress support sections are hingedly connected together for moving the stretcher into various angular configurations. If desired, more than three sections in the mattress support could also be provided.

Figure 2:
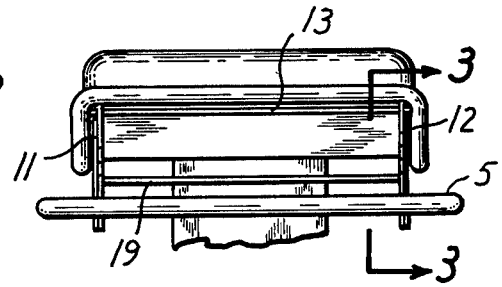
FIG. 2 is a sectional view taken along line 2—2 of FIG. 1.
Figure 3:
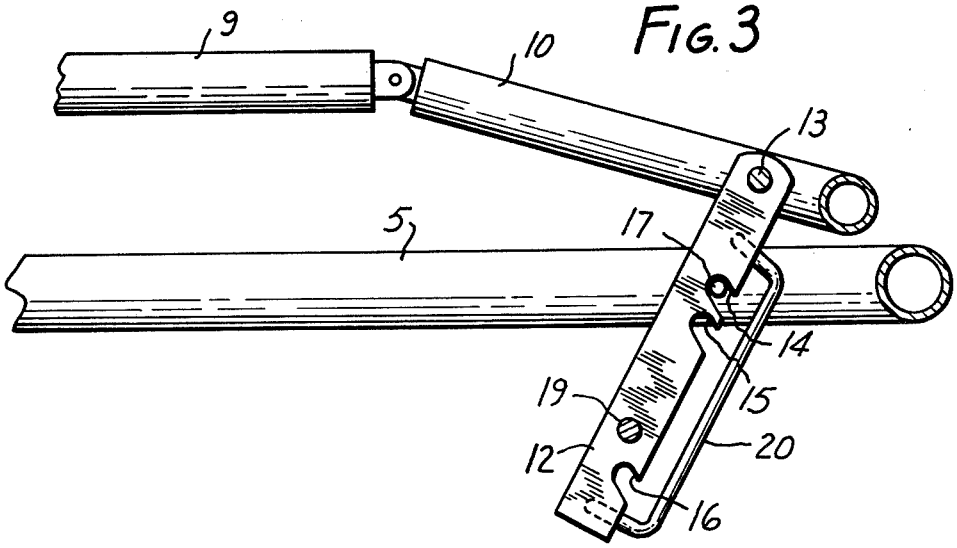
FIG. 3 is an enlarged section taken along line 3—3 of FIG. 2.

For certain patients, it is advisable to have the leg area elevated, as shown in FIG. 1. Here, as shown in FIGS. 1 and 2, a pair of braces 11 and 12 are hingedly connected to the mattress support. Preferably, this hinged connection is formed by extensions of a pivot rod 13. Each brace has a series of notches 14, 15, and 16. A protruding lug 17 engages these notches for a particular height setting of the stretcher's foot section. When the lug 17 is in the lowermost notch 16, as shown in FIG. 1, the mattress support foot section is elevated. When in notch 15, the foot section is horizontal, and when in notch 14 (FIG. 3), the foot section is angled downwardly. If only a two position foot section is desired, only a single notch or other locator can be included on each brace. The lower position can be accomplished simply by having the foot section rest on the stretcher body.

To prevent binding and disengagement of the lugs from the notches, a transverse rod 19 is connected between braces 11 and 12. This provides a precise lateral spacing between braces 11 and 12, and also provides a convenient handle area for pulling on the braces to insure the lugs are well seated in their notches. Preferably, braces 11 and 12 are angularly disposed, as shown in FIGS. 1 and 2, so the weight of the braces tend to urge the notches over the lugs as the brace slides against the lug during adjustment from one setting to another. Also, the notches in each brace are angularly disposed relative to an edge of the brace to provide an upper hook surface of the notch and a lower tapered lead-in surface of the notch.

A U-shaped rod structure 20 is welded to each brace. Preferably, this rod structure 20 is welded to an outside area of the brace so as to provide a sliding contact with substructure 5 to which each lug, as 17, is welded. U-shaped rod 20 also acts as a retainer to maintain lug 17 in close proximity to the brace notches during adjustment of the mattress support. Preferably, rod 20 has a cylindrical and smooth surface which does not substantially abrade or bind against either lug 17 or substructure 5.

In the above description, a specific example has been used to describe the invention. However, it is understood by those skilled in the art that certain modifications can be made to this example without departing from the spirit and scope of the invention.

I claim:

1. A stretcher or the like with a pair of adjustable braces pivotally connected to a hinged portion of a mattress support, wherein the improvement comprises: at least two locators on each brace; protruding stop means on the stretcher to engage a locator on each brace to position the hinged portion of the mattress support either above or below remaining portions of the mattress support; a first transverse spacer joining the braces at a location adjacent the locators to prevent binding between the braces and stop means; a second transverse spacer joining the braces at a location adjacent a pivotal connection of the braces to the mattress support; and a separately formed stop retainer secured to each brace adjacent its locator, said stop retainer having a smooth surface to prevent abrasion with the stop members.

2. A stretcher or the like as set forth in claim 1, wherein the retention member is a cylindrical rod to minimize contact between the rod and stop.

3. A stretcher or the like as set forth in claim 2, wherein the cylindrical rod is secured to an outer surface of each brace.

4. A stretcher or the like as set forth in claim 2, wherein the stop means is a protruding lug.

5. A stretcher or the like with a pair of adjustable braces connected to a hinged portion of a mattress support, wherein the improvement comprises: one or more locators on each brace; protruding stop means on the stretcher to engage the locators on the braces; and a stop retention member connected with each brace adjacent its notches and having a smooth surface that extends laterally in an outward direction from each brace to prevent binding of the braces with other sections of the stretcher.

* * * * *